US011143119B2

(12) United States Patent
Andersson et al.

(10) Patent No.: US 11,143,119 B2
(45) Date of Patent: Oct. 12, 2021

(54) METHOD FOR CONTROLLING AN INTERNAL COMBUSTION ENGINE SYSTEM

(71) Applicant: VOLVO TRUCK CORPORATION, Gothenburg (SE)

(72) Inventors: Lennart Andersson, Varberg (SE); Arne Andersson, Mölnlycke (SE); Bengt Johansson, Lund (SE); Staffan Lundgren, Hindås (SE); Nhut Lam, Bjuv (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 282 days.

(21) Appl. No.: 16/334,407

(22) PCT Filed: Sep. 23, 2016

(86) PCT No.: PCT/EP2016/072728
§ 371 (c)(1),
(2) Date: Mar. 19, 2019

(87) PCT Pub. No.: WO2018/054488
PCT Pub. Date: Mar. 29, 2018

(65) Prior Publication Data

US 2020/0232397 A1 Jul. 23, 2020

(51) Int. Cl.
*F02D 13/02* (2006.01)
*F02B 41/06* (2006.01)
(Continued)

(52) U.S. Cl.
CPC ..... *F02D 13/0223* (2013.01); *F02B 33/44* (2013.01); *F02B 41/06* (2013.01);
(Continued)

(58) Field of Classification Search
CPC .... F02D 13/0223; F02D 41/145; F02D 41/26; F02D 41/38; F02D 13/00; F02B 33/44;
(Continued)

(56) References Cited

U.S. PATENT DOCUMENTS 4,783,966 A 11/1988 Aldrich
5,072,589 A 12/1991 Schmitz
(Continued)

FOREIGN PATENT DOCUMENTS

CN 101418716 A 4/2009
CN 101779016 A 7/2010
(Continued)

OTHER PUBLICATIONS

International Search Report (dated Dec. 14, 2016) for corresponding International App. PCT/EP2016/072728.
(Continued)

*Primary Examiner* — Jacob M Amick
*Assistant Examiner* — Charles J Brauch
(74) *Attorney, Agent, or Firm* — Venable LLP; Jeffri A. Kaminski

(57) ABSTRACT

A method for controlling an internal combustion engine system, the engine system including a combustor arranged to receive air and fuel, and combust the received air and fuel, an expander arranged to expand exhaust gases from the combustion in the combustor and to extract energy from the expanded exhaust gases, and a communication valve arranged to control a communication between the combustor and the expander, including determining during operation of the engine system whether there is a pressure difference across said communication valve.

22 Claims, 6 Drawing Sheets

(51) Int. Cl.

| | |
|---|---|
| ***F02D 41/14*** | (2006.01) |
| ***F02D 41/26*** | (2006.01) |
| ***F02D 41/38*** | (2006.01) |
| ***F02G 3/02*** | (2006.01) |
| ***F02B 41/08*** | (2006.01) |
| ***F02G 1/02*** | (2006.01) |
| ***F02B 33/44*** | (2006.01) |

(52) U.S. Cl.
CPC ..... *F02B 41/08* (2013.01); *F02D 41/145* (2013.01); *F02D 41/26* (2013.01); *F02D 41/38* (2013.01); *F02G 1/02* (2013.01); *F02G 3/02* (2013.01)

(58) Field of Classification Search
CPC .. F02B 41/08; F02B 41/06; F02G 1/02; F02G 3/02
See application file for complete search history.

(56) References Cited

U.S. PATENT DOCUMENTS

| | | | | |
|---|---|---|---|---|
| 2007/0178731 | A1* | 8/2007 | Elendt | F01L 13/0036 439/157 |
| 2009/0223482 | A1* | 9/2009 | Schmitz | F02F 7/0019 123/311 |
| 2012/0260627 | A1 | 10/2012 | Durrett et al. | |
| 2013/0160726 | A1 | 6/2013 | Zajac | |
| 2014/0238009 | A1 | 8/2014 | Hoglund | |
| 2014/0261288 | A1* | 9/2014 | Coney | F02G 3/00 123/197.1 |

FOREIGN PATENT DOCUMENTS

| | | | | | |
|---|---|---|---|---|---|
| CN | 102369344 | A | | 3/2012 | |
| CN | 102959195 | A | | 3/2013 | |
| CN | 105829678 | A | | 8/2016 | |
| JP | 2010236414 | A | * | 10/2010 | |
| JP | 2010242547 | A | * | 10/2010 | |
| WO | WO-2004061272 | A2 | * | 7/2004 | F01L 7/026 |
| WO | 2009023080 | A1 | | 2/2009 | |
| WO | WO-2011132321 | A1 | * | 10/2011 | F01L 7/02 |

OTHER PUBLICATIONS

China Office Action dated Oct. 12, 2020 in corresponding China Patent Application No. 201680089437.4, 29 pages.

* cited by examiner

METHOD FOR CONTROLLING AN INTERNAL COMBUSTION ENGINE SYSTEM

BACKGROUND AND SUMMARY

The invention relates to a method for controlling an internal combustion engine system comprising a combustor, an expander arranged to expand exhaust gases from the combustor and to extract energy from the expanded exhaust gases, and an exhaust guide arranged to guide exhaust gases from the combustor to the expander. The invention also relates to a computer program, a computer readable medium, a control unit, an internal combustion engine system, and a vehicle comprising such a system.

The invention can be applied in heavy-duty vehicles, such as trucks, buses and construction equipment, e.g. working machines. The invention can also be applied to cars. Although the invention will be described with respect to a truck, the invention is not restricted to this particular vehicle type.

It is known that internal combustion engines with multiple stages of expansion may provide for extracting more energy from the fuel. An example can be found in US20120260627 describing an engine comprising a combustion cylinder and an expander cylinder arranged downstream the combustion cylinder. Exhaust gases are exhausted from the combustion cylinder by means of an outlet valve. A problem is that upon opening the outlet valve energy may be lost due to an unrestrained expansion at the outlet valve. Thus there is a desire to further reduce energy losses in multi-stage expansion engines.

It is desirable to reduce energy losses in multi-stage expansion internal combustion engines.

According to an aspect of the invention, a method is provided for controlling an internal combustion engine system comprising a combustor arranged to receive air and fuel, and combust the received air and fuel, an expander arranged to expand exhaust gases from the combustion in the combustor and to extract energy from the expanded exhaust gases, and a communication valve arranged to control a communication between the combustor and the expander, the method comprising determining during operation of the engine system determining during operation of the engine system whether there is a pressure difference across said communication valve a relationship between pressure levels on opposite sides of said communication valve.

It is understood that the combustor may comprise a combustion cylinder which is adapted to compress air and combust a fuel injected with fuel injector. It further understood that the combustor is typically arranged to repetitively receive air and fuel, combust the received air and fuel, and expand the combusted air and fuel. The engine system is preferably arranged to provide a four stroke cycle in the combustor, but alternative cycles are possible within the scope of the claims. The expander may comprise a cylinder and a piston arranged to reciprocate in the cylinder, the piston being connected to a crankshaft of the engine system. The engine system is preferably arranged to provide a two stroke cycle in the expander, but alternative cycles are possible.

In addition to determining whether there is a pressure difference across said communication valve, a relationship between pressure levels on opposite sides of said communication valve may be determined. As exemplified below, in some embodiments, the communication valve is provided as a combustor outlet valve. However, in general the communication valve may be any valve arranged to control a communication between the combustor and the expander.

Where the engine system comprises an exhaust guide arranged to guide exhaust gases from the combustor to the expander, and an expander inlet valve arranged to control a communication between the exhaust guide and the expander, and the communication valve is arranged to control a communication between the combustor and the exhaust guide, the method may comprise controlling the expander inlet valve so as to reduce said pressure difference across said communication valve. Thus, the invention provides conditions for adjusting the actuation of the expander inlet valve so as to equalize the pressure on both sides of the communication valve prior to, or at, valve opening. Thereby, energy loss due to an unrestrained expansion at the communication valve may be avoided.

According to another aspect of the invention, a method is provided for controlling an internal combustion engine system comprising a combustor arranged to receive air and fuel, and combust the received air and fuel, an expander arranged to expand exhaust gases from the combustion in the combustor and to extract energy from the expanded exhaust gases, an exhaust guide arranged to guide exhaust gases from the combustor to the expander, and an expander inlet valve arranged to control a communication between the exhaust guide and the expander, the method comprising controlling the expander inlet valve so as to adjust the pressure in the exhaust guide.

The control of the expander inlet valve may comprise controlling the expander inlet valve at least partly based on, or in dependence of, the determined pressure in the exhaust guide. By controlling the expander inlet valve, the expander swallowing capacity may be adjusted to adjust the pressure in the exhaust guide. Thereby, the pressure in the exhaust guide may be steered towards a target pressure. For example, the pressure in the exhaust guide may be controlled so that the pressure difference over a communication valve in the form of an outlet valve at the combustor is minimised, whereby unrestrained expansion at the outlet valve is eliminated.

The invention allows minimizing unrestrained expansion at the outlet valve at a variety of engine system operational conditions. For example, where the amount of fuel provided to the combustor is varied to control engine output torque, the pressure in the combustor at an opening event of a compressor outlet valve will depend on and vary with the amount of fuel supplied to the combustor. The possibility provided by the invention to minimize the pressure difference over the combustor outlet valve, will allow for avoiding unrestrained expansion at the outlet valve regardless of the varying combustor fuel supply.

The invention may also be useful where the amount of air provided to the combustor can be controlled. Such control may be provided by a throttle valve in an air guide arranged to guide air to the combustor, or by variable control of inlet and/or outlet valves of a piston compressor arranged to be driven by a crankshaft of the engine system to compress air supplied to the combustor. The compressor inlet and outlet valves may be of any suitable type, e.g. poppet valves or reed valves. Where the amount of air provided to the combustor can be controlled, the pressure in the combustor at an opening event of a compressor outlet valve will depend on and vary with the amount of air supplied to the combustor, as well as the amount of fuel supplied. The possibility provided by the invention to minimize the pressure difference over the combustor outlet valve, will allow for avoiding unrestrained expansion at the outlet valve regardless of the varying combustor air and/or fuel supply due to the air supply control.

A valve opening sequence may be understood as series of valve positions from a closed state to a subsequent closed state, without any intermediate closed state. A valve opening event may be understood as a transition of a valve from a closed state to a state where spaces on either side of the valve may communicate. A valve opening event may be followed by a valve motion which increases a cross-sectional area of a communication passage between the spaces on either side of the valve. A valve closing event may be understood as a transition of a valve from a state where the spaces on either side of the valve may communicate to a closed state. A valve closing event may be preceded by a valve motion which decreases a cross-sectional area of a communication passage between the spaces on either side of the valve.

Where the engine system comprises a pre-expander exhaust treatment device in the exhaust guide, determining the pressure in the exhaust guide may comprise determining the pressure between the combustor and the pre-expander exhaust treatment device. The exhaust gases produced by the combustion may be guided to the pre-expander exhaust treatment device in the exhaust guide, and the pre-expander exhaust treatment device may provide an exhaust treatment process to the received exhaust gases. Determining, e.g. by measuring, the pressure between the combustor and the pre-expander exhaust treatment device may provide clear data on pressure changes, e.g. due to combustor outlet valve opening events.

Preferably, where the engine system comprises a communication valve arranged to control a communication between the combustor and the exhaust guide, the method comprises determining the pressure in the combustor, whereby the control of the expander inlet valve comprises controlling the expander inlet valve at least partly based on the pressure in the combustor. Determining the pressure in the combustor may comprise determining the pressure in the combustor at an opening event of the communication valve, whereby the control of the expander inlet valve comprises controlling the expander inlet valve at least partly based on, or in dependence of, the pressure in the combustor at an opening event of the communication valve. As suggested, the communication valve may be a combustor outlet valve. By controlling the expander inlet valve based on the pressure in the exhaust guide and the pressure in the combustor at an opening event of the combustor outlet valve it is possible to securely minimise the pressure difference across the combustor outlet valve at the opening event of the combustor outlet valve, thereby eliminating energy losses due to unrestrained expansion.

Preferably, where the engine system comprises an air guide arranged to guide air to the combustor, determining the pressure in the combustor may comprise determining a temperature, a pressure and/or an air mass flow in the air guide, and determining an amount of fuel provided to the combustor, and determining the pressure in the combustor at least partly based on the determined air guide temperature, pressure and/or air mass flow, and the determined fuel amount. The method may also comprise determining the temperature in the exhaust guide, determining the pressure in the exhaust guide and/or determining the timing of injections of fuel into the combustor, and determining the pressure in the combustor partly based on the determined exhaust guide temperature, the determined exhaust guide pressure and/or the determined fuel injection timing. Thereby, the combustor pressure may be determined by readily available devices, ensuring simplicity. Also, no sensor needs to be positioned in the combustor, where the environment is though with high temperatures and pressure peaks.

The method may also comprise determining a rotational speed of the engine system, and determining the pressure in the combustor partly based on the determined rotational speed. Thereby, the influence of heat loss to a cylinder wall of the combustor may be taken into account for the combustor pressure determination. Where an intercooler is provided in the air guide, determining the pressure and/or the temperature in the air guide preferably comprises determining the pressure and/or the temperature downstream of the intercooler.

In further embodiments, where the engine system comprises a communication valve, which may be a combustor outlet valve, arranged to control a communication between the combustor and the exhaust guide, the method may comprise determining the pressure in the exhaust guide, and determining whether there is a change in the exhaust guide pressure as a result of an opening event of the communication valve. Such a change in the exhaust guide pressure may serve as an indication that there is a pressure difference across the communication valve at the opening event of the communication valve. Thereby, a simple and robust solution is provided for determining whether there is a pressure difference across the combustor outlet valve, without having to provide a sensor within the combustor. A pressure sensor may be arranged in the exhaust guide, and such a sensor may work as a virtual sensor for the combustor pressure. If there is a sudden increase or decrease in the exhaust guide pressure at the combustor outlet valve opening event, the expander inlet valve control may be adjusted so as to minimise such a pressure increase or decrease.

In some embodiments determining the pressure in the combustor may be done by a pressure detection in the combustor, whereby an accurate pressure determination may be obtained.

As suggested, advantageously, controlling the expander inlet valve may comprise controlling the expander inlet valve so as for the pressure in the exhaust guide to be the same as the pressure in the combustor. Preferably, controlling the expander inlet valve may comprise controlling the expander inlet valve so as for the pressure in the exhaust guide to be the same as the pressure in the combustor at an opening event of the communication valve, avoiding unrestrained expansion creating energy losses. Instead a smooth gas flow may be created between the combustor and the exhaust guide, whereby pressure pulses are eliminated. The opening event of the communication valve may for example be at a bottom dead centre (BDC) position of a piston in the combustor.

Preferably, controlling the expander inlet valve comprises controlling a timing of an opening event and/or a closing event of the expander inlet valve. For example, where the expander comprises a cylinder and a piston arranged to reciprocate in the cylinder, the piston being connected to a crankshaft of the engine system, controlling the expander inlet valve may comprise controlling an opening event of the expander inlet valve so as to occur between 10 degrees before and 10 degrees after a top dead centre (TDC) position of the piston. As a further example, controlling the expander inlet valve may comprise controlling a closing event of the expander inlet valve so as to occur between 15 degrees after and 90 degrees after a top dead centre (TDC) position of the piston. As exemplified below, the swallowing capacity of the expander may, in particular with a control of the expander inlet valve closing event, be effectively controlled, in turn providing an accurate control of the exhaust guide pressure. To decrease the exhaust guide pressure, the expander swallowing capacity may be increased by the expander inlet valve closing relatively late, and vice versa.

The expander inlet valve being controllable so as to close up to 90 degrees after TDC may be advantageous e.g. where a turbo expander is provided downstream of the expander. The closing event of the expander inlet valve may in some embodiments be controlled so as to occur between 45 degrees after and 90 degrees after TDC. In further embodiments, the closing event of the expander inlet valve may in some embodiments be controlled so as to occur between 15 degrees after and 70 degrees after TDC. In additional embodiments, the closing event of the expander inlet valve may in some embodiments be controlled so as to occur between 45 degrees after and 70 degrees after TDC.

Preferably, the expander inlet valve opening event is controlled so as to occur before TDC, e.g. between 10 degrees before TDC and TDC. Thereby, the expander piston will be close to the top in the expander cylinder, providing a relatively small volume for gases from the exhaust guide to enter, thereby reducing losses where the pressure in the exhaust guide is higher than the pressure in the expander at the expander inlet valve opening event.

In some embodiments, controlling the expander inlet valve may comprise controlling a degree of opening, e.g. a degree of maximum opening, of the expander inlet valve. Thereby, an effective manner of adjusting the expander swallowing capacity may be provided.

Preferably, where the expander comprises a cylinder and a piston arranged to reciprocate in the cylinder, the piston being connected to a crankshaft of the engine system, and where the engine system comprises an exhaust conduit arranged to guide the exhaust gases from the expander, e.g. to the atmosphere, and an expander outlet valve arranged to control a communication between the expander and the exhaust conduit, the method comprises closing the expander outlet valve before a top dead centre (TDC) position of the expander piston so as to obtain a compression of exhaust gases in the expander before an opening event of the expander inlet valve. The compression of exhaust gases in the expander may be such that the pressure in the expander is 30%-100% of the pressure in the exhaust guide at the opening event of the expander inlet valve. The compression of the exhaust gases in the expander may provide a pressure e.g. essentially half of the pressure in the exhaust guide. Thereby, an unrestrained expansion at the opening of the expander inlet valve may be reduced or avoided, thus reducing energy losses.

According to another aspect of the invention, an internal combustion engine system is provided comprising a combustor arranged to receive air and fuel, and combust the received air and fuel, an expander arranged to expand exhaust gases from the combustion in the combustor and to extract energy from the expanded exhaust gases, an exhaust guide arranged to guide exhaust gases from the combustor to the expander, and expander inlet valve arranged to control a communication between the exhaust guide and the expander, wherein the engine system comprises pressure determining means arranged to determine the pressure in the exhaust guide, the expander inlet valve being arranged so as to present a variable and controllable opening sequence.

The pressure determining means may comprise a pressure sensor in the exhaust guide. By means of the pressure determining means and the variable and controllable opening sequence expander inlet valve, it is possible to control the expander inlet valve so as to adjust the pressure in the exhaust guide. As suggested above, by controlling the expander inlet valve, the expander swallowing capacity may be adjusted to adjust the pressure in the exhaust guide. Thereby, the pressure in the exhaust guide may be controlled so that the pressure difference over a combustor outlet valve is minimised, whereby unrestrained expansion at the outlet valve is eliminated.

The variable and controllable opening sequence of the expander inlet valve may be provided by a cam switching arrangement, a cam phasing arrangement, a coaxial two shaft combined cam lobe profile, or an arrangement with hydraulic and/or pneumatic valve actuation. Thereby, the swallowing capacity of the expander may be effectively adjusted. However, any suitable solution may be provided for the variable and controllable opening sequence actuation of the expander inlet valve. For example, a camless solution such as the one described in US2014238009A1 may provide the variable and controllable opening sequence actuation of the expander inlet valve.

In some embodiments, the expander inlet valve may comprise a rotatable valve body presenting a valve body opening located offset from a rotational axis of the valve body, the communication between the exhaust guide and the expander being controllable by changing the circumferential location of the valve body opening. As exemplified below, thereby challenges with interference between the valve and a piston of the expander may be avoided, since the valve may not extend into the cylinder when actuated.

In some embodiments, the system may be arranged to provide an injection of fuel into the exhaust guide and/or arranged to provide an injection of fuel into the combustor after a combustion in the combustor and before a reception of air and fuel in the combustor for a subsequent combustion. As exemplified below, fuel from such fuel injections, herein also referred to as second fuel injections, may mix with air in the exhaust gases produced by combustions in the combustor, to react in a pre-expander exhaust treatment device located upstream of the expander. Thereby, the system may be arranged to adjust the expander inlet valve control in dependence on the second fuel injections. More specifically, the reaction in the pre-expander exhaust treatment device will increase the temperature of the exhaust gases which in turn reduces the swallowing capacity of the expanders. Thereby, the expander inlet valve control may be adjusted to increase the expander swallowing capacity to compensate for the increased exhaust gas temperature.

According to another aspect of the invention, a vehicle comprising an engine system is provided.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION

Figure 1:
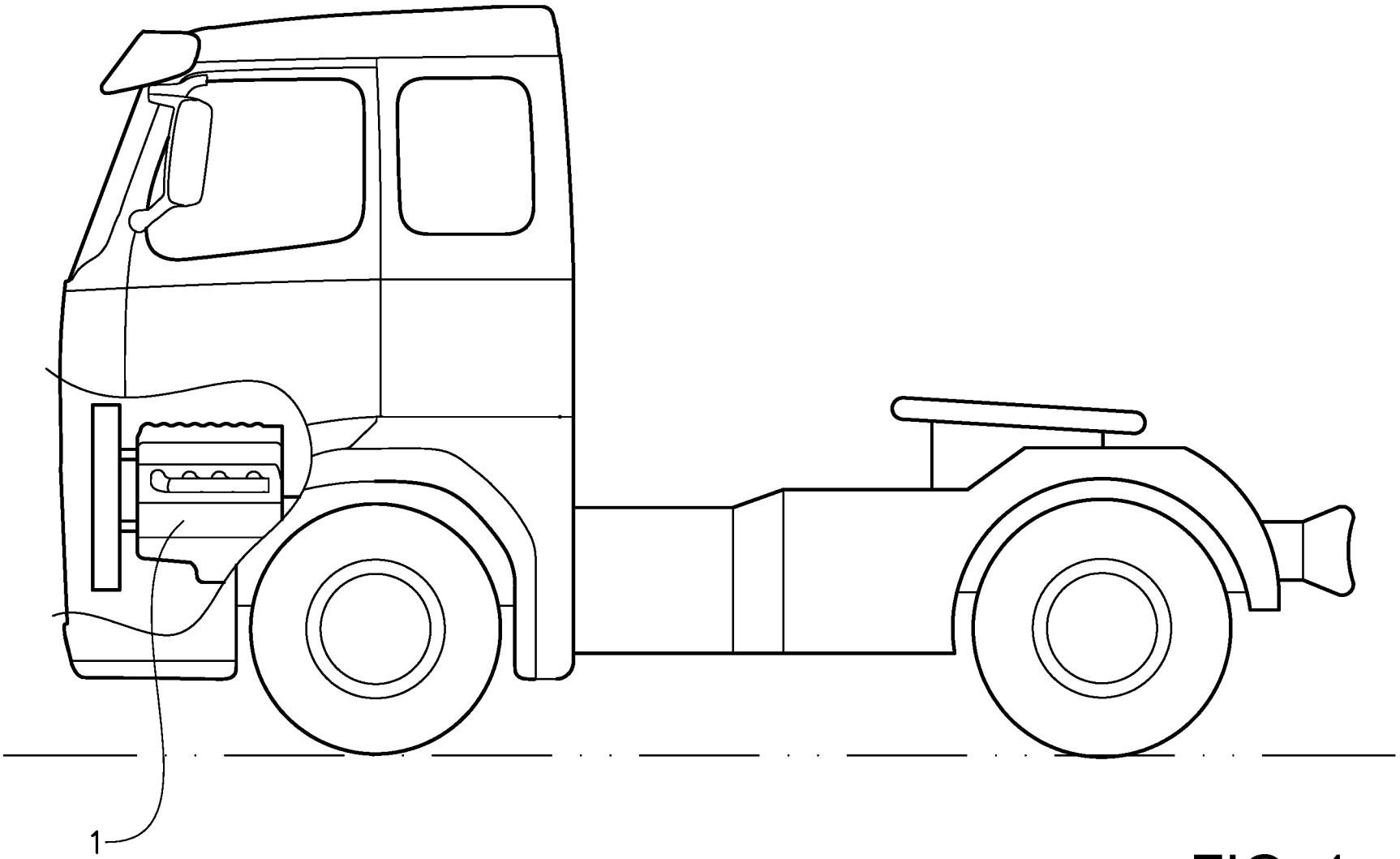
FIG. 1 is a partially sectioned side view of a vehicle in the form of a truck.

FIG. 1 shows a vehicle in the form of a truck, or a tractor for a semitrailer. It should be noted however that the invention is applicable to a variety of alternative types of vehicles, such as a car, a bus, or a working machine such as a wheel loader. The vehicle comprises an internal combustion engine system 1.

Figure 2:
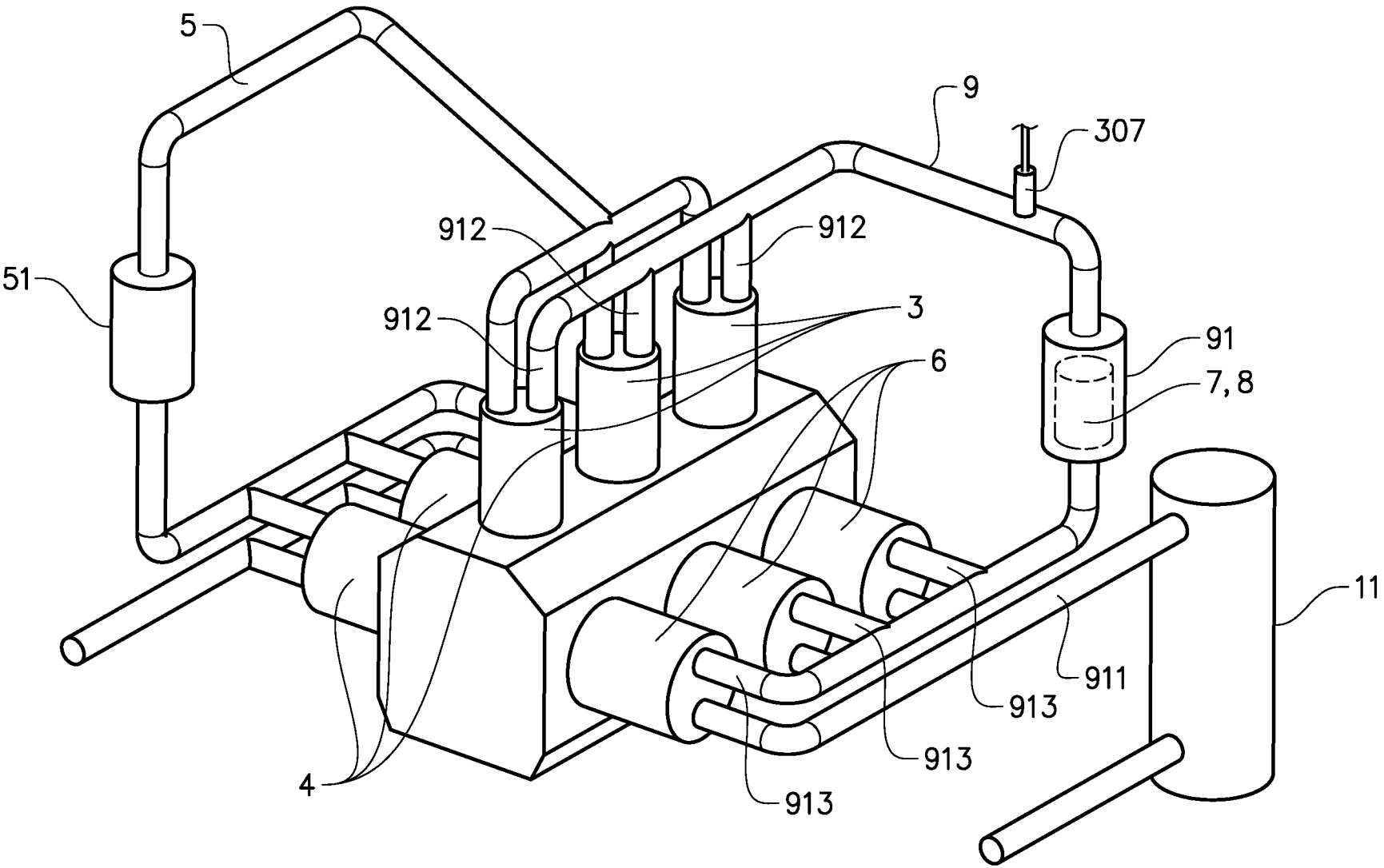
FIG. 2 is a schematic perspective view of an engine system in the vehicle in FIG. 1.

FIG. 2 is schematic and does not show, for simplicity of this presentation, certain parts such as devices for the actuation of inlet and outlet valves in cylinders of the engine system. The engine system 1 comprises a multi-stage compression and expansion internal combustion engine. The engine comprises three combustors 3, in the form of cylinders with pistons, and three piston compressors 4.

The system further comprises an air guide 5 arranged to guide compressed air from the compressors 4 to the combustors 3. The air guide is provided with an air buffer container 51, arranged to receive compressed air from the compressors 4, to provide an air buffer volume for the compressed air, and to deliver the compressed air to the combustors 3. It should be noted that the air guide may be provided with an intercooler (not shown). The intercooler may be located in the air buffer container 51.

The system further comprises three piston expanders 6 arranged to expand exhaust gases from the combustors 3 and to extract energy from the expanded exhaust gases. An exhaust guide 9 is arranged to guide exhaust gases from the combustors 3 to the expanders 6. The exhaust guide 9 presents combustor branches 912, each for connecting the exhaust guide 9 to a respective of the combustors 3. The exhaust guide 9 also presents expander branches 913, each for connecting the exhaust guide 9 to a respective of the expanders 6. The exhaust guide 9 further comprises an exhaust buffer container 91 described closer below.

It is understood that the engine system may comprise any number of combustors 3, compressors 4, and expanders 6. In this example, the combustors 3, compressors 4, and expanders 6 share a single air buffer 51 and a single exhaust buffer container 91. However, the number of air guides 5, air buffers 51, exhaust guides 9, and exhaust buffer containers 91 may vary as well. For example, it is conceivable that a plurality of air guides 5 with respective air buffers 51 extend between respective pairs of compressors 4 and combustors 3. Also, in some embodiments, there may be more than one exhaust guide 9 with respective exhaust buffer containers 91 extending between respective pairs of combustors 3 and expanders 6. In is also conceivable that there are two or more air guides, and two or more exhaust guides, connected to respective groups of combustors.

The engine system further comprises an exhaust conduit 911 arranged to guide exhaust gases from the expanders 6.

Figure 3:
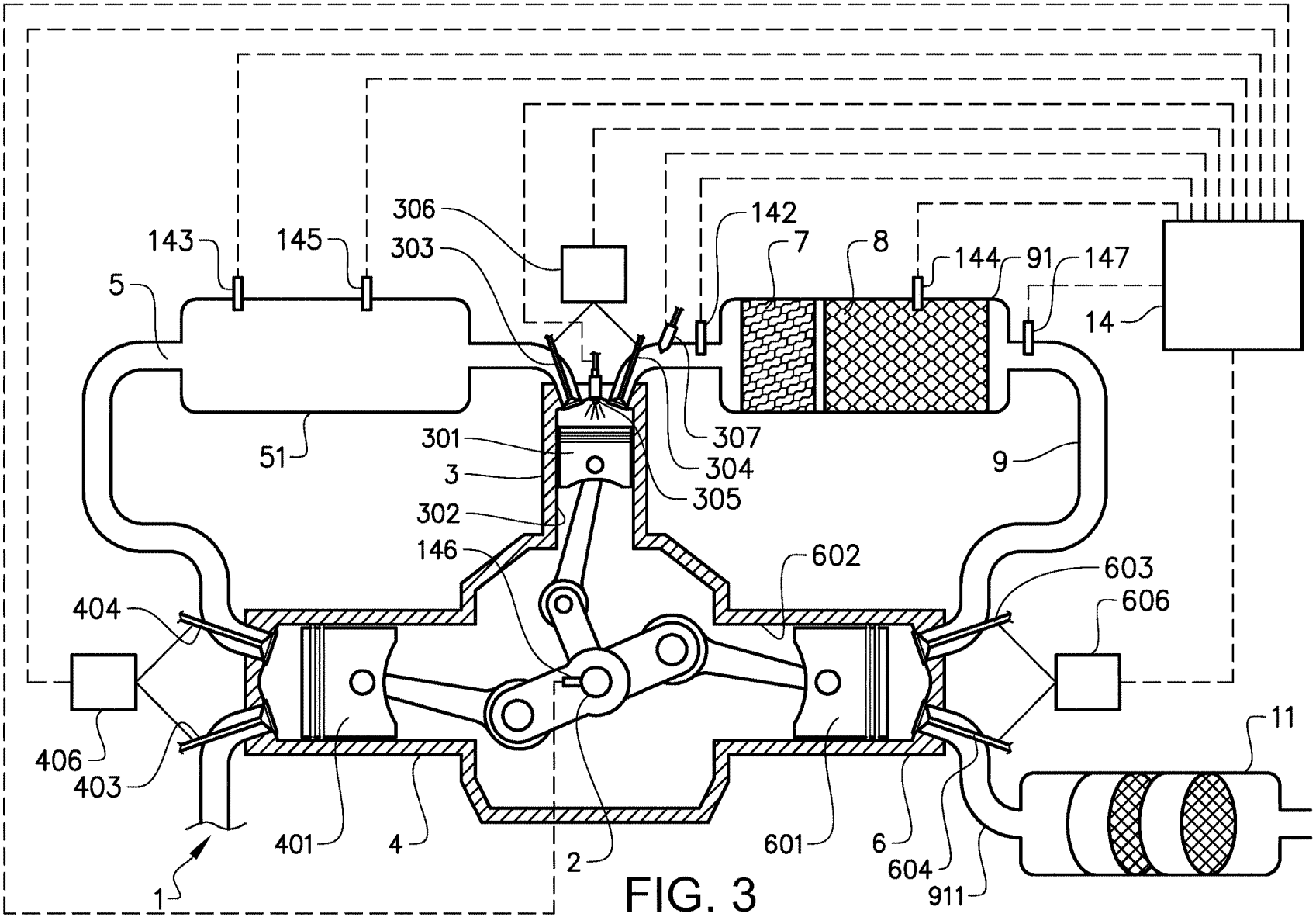
FIG. 3 is a schematic cross-sectional view of the engine system in FIG. 2.

Reference is made to FIG. 3 in which only one of the combustors 3, only one of compressors 4, and only one of the expanders 6 are shown. For simplicity, the combustor 3, the compressor 4, and the expander 6 are shown as all being located in the same cross-sectional plane; in a real implementation of the embodiment, the combustor 3, the compressor 4, and the expander 6 are preferably offset in relation to each other along the crankshaft 2.

The piston 301 of each combustor 3 is arranged to reciprocate in the respective cylinder 302, whereby the pistons are all arranged to drive a crankshaft 2 of the engine. The combustors 3 are arranged to repetitively receive air and fuel, combust the received air and fuel, and expand the combusted air and fuel. The pistons 601 of the expanders 6 are arranged to drive the crankshaft 2 with the energy extracted from the exhaust gases from the combustors 3. Further, the pistons 401 of the compressors 4 are all arranged to be driven by the crankshaft 2.

The engine system comprises a control unit 14 arranged to control various function of the system as described below.

The combustors 3 are provided with respective sets of combustor inlet and outlet valves 303, 304, arranged to be actuated by a combustor valve actuator assembly 306. The outlet valve 304 of the respective combustor 3 is herein also referred to as a communication valve 304 and is arranged to control a communication between the combustor 3 and the expanders 6, more specifically between the combustor 3 and the respective combustor branch 912 (FIG. 2) of the exhaust guide 9. The combustor valve actuator assembly 306 may be arranged to actuate the combustor inlet and outlet valves 303, 304 in any manner known per se, e.g. with cams mounted on camshafts. The combustor valve actuator assembly 306 is controllable by the control unit 14, to adjust the timing and the maximum movements of the combustor inlet and outlet valves 303, 304. The combustor valve actuator assembly 306 may comprise any suitable type of variable valve actuation arrangement, such as a cam switching arrangement, a cam phasing arrangement, an arrangement with a coaxial two shaft combined cam lobe profile, or an arrangement with hydraulic and/or pneumatic valve actuation.

The expanders 6 are provided with respective sets of expander inlet and outlet valves 603, 604, arranged to be actuated by an expander valve actuator assembly 606, including e.g. cams mounted on camshafts. Each expander inlet valve 603 is arranged to control a communication between a respective expander branch 913 (FIG. 2) of the exhaust guide 9 and the respective expander 6. Each expander outlet valve 604 is arranged to control a communication between the respective expander 6 and the exhaust conduit 911.

The expander valve actuator assembly 606 is controllable by the control unit 14, to adjust the timing and the maximum movements of the expander inlet and outlet valves 603, 604. Thereby, the expander inlet and outlet valves 603, 604 are arranged so as to present a variable and controllable opening sequences. The expander valve actuator assembly 606 may comprise any suitable type of variable valve actuation arrangement, such as a cam switching arrangement, a cam phasing arrangement, an arrangement with a coaxial two shaft combined cam lobe profile, or an arrangement with hydraulic and/or pneumatic valve actuation.

As stated, a valve opening sequence may be understood as series of valve positions from a closed state to a subsequent closed state, without any intermediate closed state. A valve opening event may be understood as a transition of a valve from a closed state to a state where spaces on either side of the valve may communicate. A valve opening event may be followed by a valve motion which increases a cross-sectional area of a communication passage between the spaces on either side of the valve. A valve closing event may be understood as a transition of a valve from a state where the spaces on either side of the valve may communicate to a closed state. A valve closing event may be preceded by a valve motion which decreases a cross-sectional area of a communication passage between the spaces on either side of the valve.

In addition, the compressors 4 are provided with respective sets of said compressor inlet and outlet valves 403, 404, arranged to be actuated by a compressor valve actuator assembly 406, including e.g. cams mounted on camshafts. The compressor valve actuator assembly 406 is controllable by the control unit 14, to adjust the timing and the maximum movements of the compressor inlet and outlet valves. The compressor valve actuator assembly 406 may comprise any suitable type of variable valve actuation arrangement, such as a cam switching arrangement, a cam phasing arrangement, an arrangement with a coaxial two shaft combined cam lobe profile, or an arrangement with hydraulic and/or pneumatic valve actuation.

For receiving the fuel, the combustors 3 are provided with respective main fuel injectors 305 for injecting a fuel into the cylinders 302. The fuel may be of any suitable type, e.g. diesel, methane e.g. in liquid natural gas (LNG), gasoline, etc. The main fuel injectors 305 are controllable by the control unit 14. In this example, the combustors 3 are arranged to provide a Diesel cycle to extract work from the air and fuel provided. However, the invention is equally applicable to engines in which the combustors are arranged to provide an Otto cycle, wherein the engine system may be provided with means for air mass flow control, such as variable inlet and outlet valves of the compressors 4, described further below, for controlling the air supply to the combustors 3. Alternatively, or in addition, the means for air mass flow control may comprise one or more throttles for controlling the air supply to the combustors 3. The engine system may be provided with spark plugs in the combustors.

A pre-expander exhaust treatment device 7, 8 is located in the exhaust buffer container 91, and arranged to provide an exhaust treatment process to the exhaust gases from the combustors 3. The pre-expander exhaust treatment device 7, 8 comprises a three way catalytic converter 7 of a nitrogen oxide (NOx) storage type, and a particulate filter 8 located downstream of the three way catalytic converter 7.

Thus, in the multi-stage compression and expansion engine in this example, the compressors 4 are arranged to compress the air, the combustors are arranged to compress the air further, and to expand the gases in the combustors 3, and the expanders 6 are arranged to expand the gases further.

It is preferred that the expansion ratio of the expanders 6 is at least 30% of a total expansion ratio of the combination of the combustors 3 and the expanders 6. In this embodiment, the expansion ratio of the expanders 6 is larger than an expansion ratio of the combustor 3.

The system further comprises a post-expander exhaust treatment device 11 arranged to receive exhaust gases from the expander 6 via the post expander exhaust conduit 911, and to provide an exhaust treatment process to the received exhaust gases. The post-expander exhaust treatment device 11 is in this example a selective catalytic reduction (SCR) catalyst.

As can be seen also in FIG. 2, the system comprises a post combustion injector 307 arranged to inject fuel into the exhaust guide 9, upstream of the downstream of the pre-expander exhaust treatment device 7, 8, and downstream of the combustor branches 912. It should be noted that in alternative embodiments, the post combustion fuel injector 307 may be arranged to inject fuel into one of the combustor branches 912 of the exhaust guide 9. In further embodiments, the system may comprise a plurality of post combustion fuel injectors 307, each arranged to inject fuel into a respective of the combustor branches 912.

As suggested by FIG. 3, the post combustion fuel injector 307 is controllable by the control unit 14. The control unit 14 may be arranged to control fuel injections in the system as follows:

The control unit 14 is arranged to control first fuel injections by means of the main fuel injectors 305 into the cylinders 302 the combustors 3, in each of repeated cycles in the combustors 3. The first fuel injections is done at top dead centre positions of the pistons 301 at the end of compression strokes in the respective cycles, followed by expansions until the respective combustor exhaust valve 304 is opened. Nitrogen oxides (NOx) in the received exhaust gases are stored in the three way catalytic converter 7. In the expanders 6 a second expansion of the received exhaust gases is allowed. The exhaust gases are then received from the expanders 6 by the post-expander exhaust treatment device 11.

The control unit 14 is arranged to control second fuel injections by means of the post combustion fuel injector 307, into the exhaust guide 9, upstream of the three way catalytic converter 7. Fuel from the second fuel second fuel injections is reacted with air in the received exhaust gases and a portion of the nitrogen oxides (NOx) stored in the three way catalytic converter 7, to produce nitrogen (N2) and ammonia (NH3). In the SCR process of the post-expander exhaust treatment device 1 the produced ammonia (NH3) is allowed to react with nitrogen oxides (NOx) in the exhaust gases from the pre-expander exhaust treatment device 7, 8 to produce nitrogen (N2).

The control unit 14 is arranged to control, at relatively high torques of the engine system, the first fuel injections so as for the combustions in the combustors 3 to be lean combustions with a relatively low lambda value for a Diesel cycle, for example 1.1-1.3, e.g. around 1.2. Thereby, the control unit 14 is arranged to control the second fuel injection so as for fuel from the second fuel injection to provide, with air in the exhaust gases produced by the combustion, a substantially stoichiometric mixture of air and fuel. In the pre-expander exhaust treatment device 7, 8 fuel from the second fuel injection reacts with air in the received exhaust gases to produce heat. In the expanders 6, the heat produced by the exhaust treatment process is converted to mechanical energy in the second expansion in the expander 6.

It should be noted that in some embodiments, the second fuel injection may be done into the combustors 3, after respective combustions therein and before a reception of air and fuel in the respective combustor for a respective subsequent combustion. E.g. the second fuel injections may be done during the power or exhaust stroke of the respective combustor 3. In further embodiments, the engine system may not be arranged to provide any second fuel injections as exemplified above.

The control unit 14 is arranged to receive signals from pressure determining means 142, comprising a pressure sensor 142, arranged to determine or detect the pressure in the exhaust guide 9. In this embodiment the pressure sensor 142 is located between the combustors 3 and the exhaust buffer container 91. However, alternative location are possible, such as at the particulate filter 8, at the three way catalytic converter 7, or between the exhaust buffer container 91 and the expanders 6.

In this embodiment, a pressure detection device 147 in the form of a sensor is located between the exhaust buffer container 91 and the expanders 6. By comparing signals from the pressure determining means 142 upstream of the particulate filter 8 and the pressure detection device 147 downstream of the particulate filter 8, a degree of soot accumulation in the particulate filter 8 may be determined.

A pressure sensing device 143 is arranged to detect the pressure in the air guide 5. In this embodiment the pressure sensing device 143 is arranged to detect the pressure in the air buffer container 51. The control unit 14 is arranged to receive signals from the pressure sensing device 143. The control unit 14 is also arranged to receive signals from a temperature sensor 144 arranged to detect the temperature in the exhaust guide 9. In this embodiment the temperature sensor 144 is located at the particulate filter 8 in the exhaust buffer container 91. The control unit 14 is also arranged to receive signals from a temperature sensing device 145 arranged to detect the temperature in the air guide 9. In this embodiment the temperature sensing device 145 is located at the air buffer container 51. It should be noted that where the engine system comprises an intercooler in the air guide 5, the temperature sensing device 145 is preferably arranged to detect the temperature downstream of the intercooler. The control unit 14 is further arranged to receive signals from a rotational speed sensor 146 arranged to detect the rotational speed of the crankshaft 2, i.e. the rotational speed of the engine system.

Figure 4:
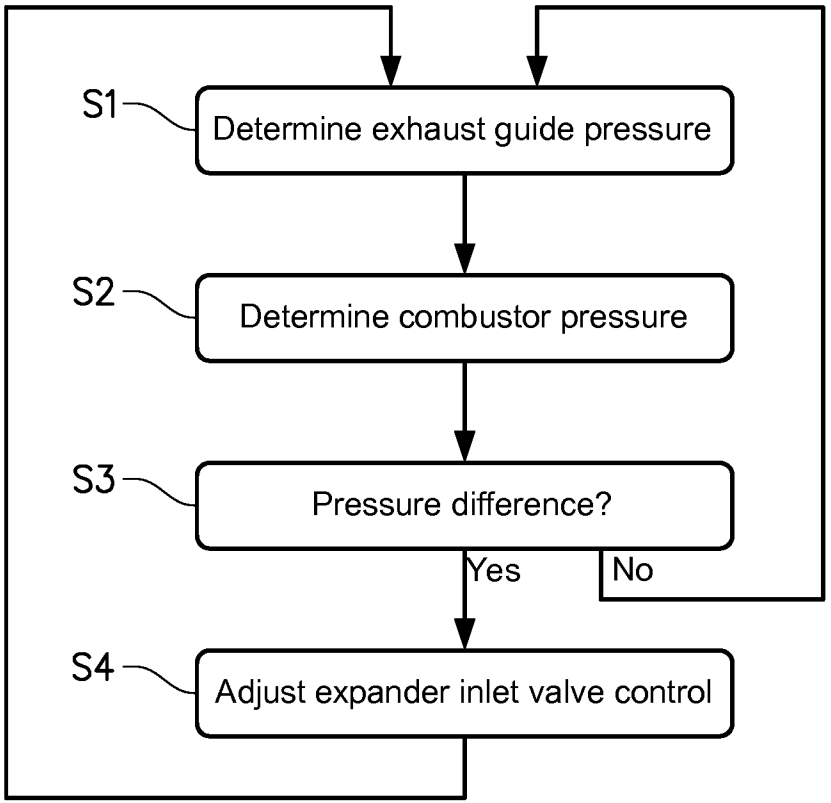
FIG. 4 is a block diagram showing steps in a method to control the system in FIG. 3.

Reference is made to FIG. 4 depicting steps in a method of operating the engine system. The method comprises determining during operation of the engine system a relationship between pressure levels on opposite sides of said combustor outlet valves 304. Determining this relationship includes determining S1 by means of the pressure sensor 142 the pressure in the particulate filter 8.

Determining said relationship also includes determining S2 the pressure in the combustors 3 at an opening event of the respective outlet valve 304. For this the pressure in the air guide 5 is determined by means of the pressure sensing device 143. Also, the temperature in the air guide 5 is determined by means of the temperature sensing device 145. In addition, the rotational speed of the engine system is determined by means of the rotational speed sensor 146. Further, an amount of fuel provided to the combustors 3 by means of the main fuel injectors 305. Also, the timing of injections of the main fuel injectors 305 is determined.

The control unit 14 is arranged to determine S2, based on the determined pressure in the air guide 5, the timing of opening and closing events of the combustor inlet valves 303, the determined temperature in the air guide 5, the determined rotational speed, the injected fuel amount and timing, the pressure in the combustors 3 at the opening events of the outlet valves 304. It is understood that other parameters may be used for determining the pressure in the combustors 3 at the opening events of the outlet valves 304, e.g. a temperature of a cooling liquid of a cooling system of the engine system.

The control unit 14 then determines the relationship between pressure levels on opposite sides of the combustor outlet valves 304. This determination comprises determining S3 whether there is a difference in the exhaust guide pressure and the pressure in the combustors 3 at the opening events of the outlet valves 304.

In alternative embodiments, instead of the pressure in the air guide 5, the air mass flow in the air guide 5, determined by means of a suitable air mass flow sensor (not shown) at the air guide 5, may be used as an input parameter to the determination of the pressure in the combustors 3 at the opening events of the outlet valves 304.

In further embodiments, the pressure in the combustors 3 at the opening events of the outlet valves 304 may be determined by direct measurements in one or more of the cylinders 302 of the combustors 3.

In additional embodiments, the pressure in the combustors 3 at the opening events of the outlet valves 304 may be determined by measuring the pressure in the exhaust guide 9, close to one or more of the combustors 3, e.g. in one or more of the combustor branches 912 of the exhaust guide 9 (FIG. 2). From pressure fluctuations in the combustor branch 912, the relationship between pressure levels on opposite sides of the combustor outlet valve 304 may be determined. For example if there is a sudden increase or decrease in the pressure measured in the combustor branch 912 at the opening events of the outlet valves 304, it may be determined that the pressure levels on opposite sides of the combustor outlet valve 304 at the opening events of the outlet valves 304 is dissimilar.

If it is determined S3 that there is no difference between the exhaust guide pressure and the pressure in the combustors 3 at the opening events of the outlet valves 304, the steps S1, S2 of determining the exhaust guide pressure and the pressure in the combustors 3 at the opening events of the outlet valves 304 are repeated.

If there is a difference between the exhaust guide pressure and the pressure in the combustors 3 at the opening events of the outlet valves 304, the control of the expander inlet valves 603 is adjusted S4 by means of the expander valve actuator assembly 606 so as for the pressure in the exhaust guide 9 to be the same as the pressure in the combustors 3 at the opening events of the combustor outlet valves 304.

Adjusting S4 the expander inlet valve control may comprise adjusting the timing of the opening events and/or the closing events of the expander inlet valves 603. For example, the opening events of the respective expander inlet valves 603 may be controlled so as to occur at a top dead centre (TDC) position of the respective expander pistons 601, and the closing events of the expander inlet valves 603 may be adjusted to adjust the pressure on the exhaust guide 9. E.g. the closing events of the expander inlet valves 603 may be advanced if it is desired to increase the pressure in the exhaust guide 9, and the closing events of the expander inlet valves 603 may be postponed if it is desired to decrease the pressure in the exhaust guide 9. The closing events of the expander inlet valves 603 may for example be varied within an interval between 15 degrees after and 90 degrees after the TDC position of the pistons 601.

In some embodiments, the pressure in the exhaust guide 9 may be controlled by adjusting the opening events of the expander inlet valves 603.

In some embodiments, the pressure in the exhaust guide 9 may be controlled by adjusting the degree of opening of the expander inlet valves 603.

It is understood that the pressure in the exhaust guide 9 is adjusted by adjusting the swallowing capacity of the expanders 6 by adjusting the control of the expander inlet valves 603. In some embodiments, the expander inlet valve control may be adjusted in dependence on the second fuel injections by the post combustion fuel injector 307. More specifically, where a reaction between fuel from the post combustion fuel injector 307 and air in the exhaust gases from the combustors 3 is provided in the pre-expander exhaust treatment device 7, 8, as exemplified above, the reaction will increase the temperature of the exhaust gases which in turn reduces the swallowing capacity of the expanders 6. For example, for a given pressure in the exhaust guide 9, where fuel is injected by the post combustion fuel injector 307, the closing events of the expander inlet valves 603 may be postponed to compensate for the increased exhaust gas temperature.

As understood from FIG. 4, when the expander inlet valve control has been adjusted S4, the steps S1, S2 of determining the exhaust guide pressure and the pressure in the combustors 3 at the opening events of the outlet valves 304 are repeated.

Preferably, the expander outlet valves 604 are controlled so that the closing events of the expander outlet valves 604 occur before the TDC position of the pistons 601 so as to obtain a compression of exhaust gases in the expanders 6 before the respective opening events of the expander inlet valves 603. For example, the compression of exhaust gases in the expanders 6 may be such that the maximum pressure in the expanders 6 is 30%-100% of the pressure in the exhaust guide 9 at the opening events of the expander inlet valves 603. This will reduce the pressure difference over the expander inlet valves 603, and hence reduce losses due to unrestrained expansions at the expander inlet valves 603.

Figure 5:
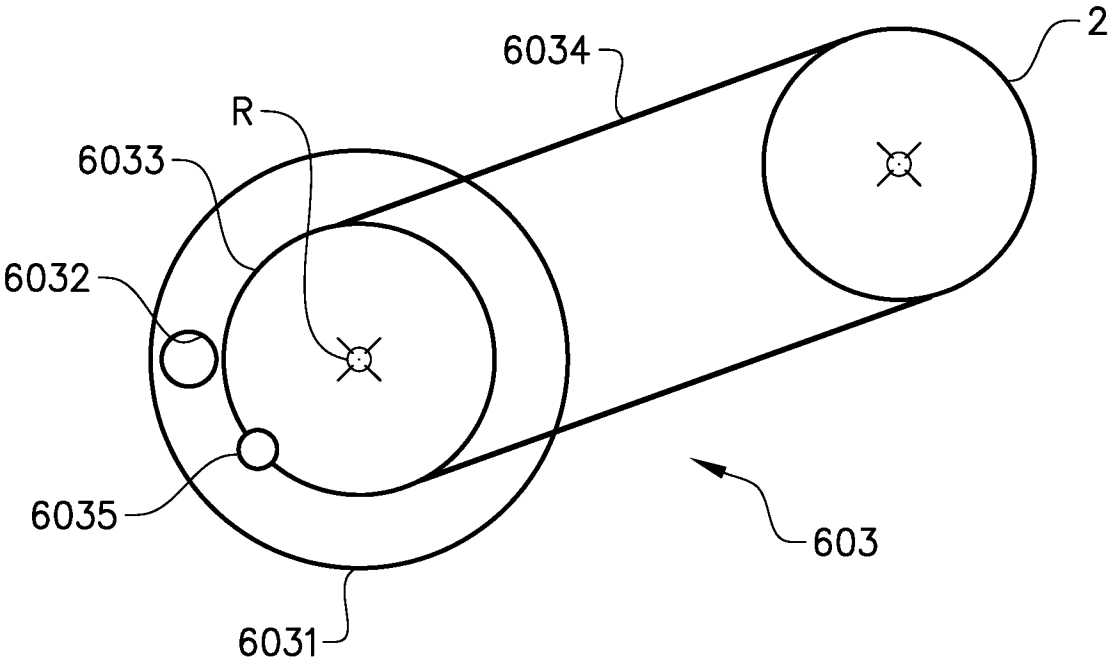
FIG. 5 shows schematically a top view of an expander inlet valve in an engine system according to an alternative embodiment of the invention.

Reference is made to FIG. 5. The expander inlet valves 603 are in FIG. 3 indicated as poppet valves. Other forms of valves may be used. For example, the expander inlet valves 603 may comprise as suggested in FIG. 5 a rotatable valve body 6031 presenting a valve body aperture 6032 located offset from a rotational axis R of the valve body 6031. The communication between the exhaust guide 9 and the expander 6 is thereby controllable by changing the circumferential location of the valve body aperture 6032. This is done by rotating the valve body 6031 by means of the crankshaft 2. In this example, the valve body 6031 is mounted to a drive device 6033, which in turn is arranged to be driven by the crankshaft 2 via a chain or belt 6034.

A phasing adjuster 6035 is provided and controllable so as to change the rotational position of the valve body 6031 in relation to the drive device 6033. Thereby, the timing of the expander inlet valve 603 may be adjusted so as to adjust the pressure in the exhaust guide 9, similarly to what has been described above with reference to FIG. 4. The phasing adjuster 6035 may be driven in any suitable manner, e.g. hydraulically, electrically or pneumatically. The expander inlet valve 603 in FIG. 5 has the advantage that challenges with interference between the valve 603 and the expander piston 601 is avoided, since the valve does not extend into the cylinder when actuated.

Figure 6:
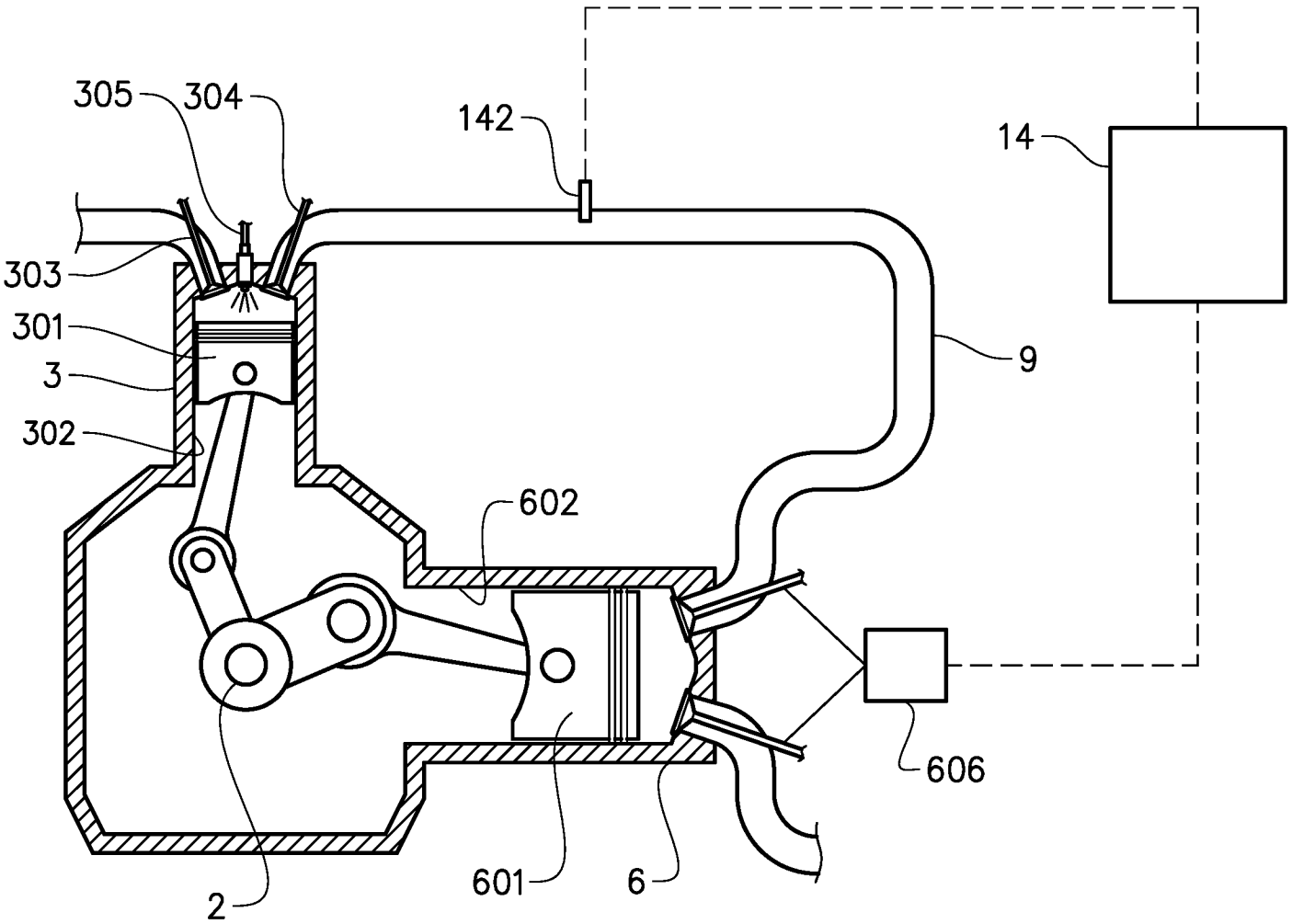
FIG. 6 is a schematic cross-sectional view of an engine system according to a further embodiment of the invention.

Reference is made to FIG. 6 depicting an engine system according to an alternative, simpler embodiment of the invention. The system 1 comprises a combustor 3 arranged to repetitively receive air and fuel, combust the received air and fuel, and expand the combusted air and fuel, an expander 6 arranged to expand exhaust gases from the combustion in the combustor 3 and to extract energy from the expanded exhaust gases, and an exhaust guide 9 arranged to guide exhaust gases from the combustor 3 to the expander 6. The system further comprises an expander inlet valve 603 arranged to control a communication between the exhaust guide 9 and the expander 6. The actuation of the expander inlet valve 603 presents by means of an expander valve actuator assembly 606, controllable by a control unit 14, a variable and controllable opening sequence. The engine system also comprises pressure determining means 142 by means of which the pressure in the exhaust guide 9 may be determined. The expander inlet valve 603 may thereby be controlled so as to adjust the pressure in the exhaust guide 9.

It is to be understood that the present invention is not limited to the embodiments described above and illustrated in the drawings; rather, the skilled person will recognize that many changes and modifications may be made within the scope of the appended claims.

The invention claimed is:

1. A method for controlling an internal combustion engine system comprising a combustor arranged to receive air and fuel, and combust the received air and fuel, an expander arranged to expand exhaust gases from the combustion in the combustor and to extract energy from the expanded exhaust gases, and an exhaust guide arranged to guide exhaust gases from the combustor to the expander, an expander inlet valve arranged to control a communication between the exhaust guide and the expander, and an air guide arranged to guide air to the combustor, the method comprising controlling the expander inlet valve so as to adjust the pressure in the exhaust guide, comprising determining the pressure in the exhaust guide, whereby the control of the expander inlet valve comprises controlling the expander inlet valve at least partly based on the determined pressure in the exhaust guide, and further determining the pressure in the combustor comprises determining a temperature, a pressure and/or an air mass flow in the air guide, and determining an amount of fuel provided to the combustor, and determining the pressure in the combustor at least partly based on the determined air guide temperature, pressure and/or air mass flow, and the determined fuel amount.

2. A method according to claim 1, where the engine system comprises a pre-expander exhaust treatment device in the exhaust guide, wherein determining the pressure in the exhaust guide comprises determining the pressure between the combustor and the pre-expander exhaust treatment device.

3. A method according to claim 1, where the engine system comprises a communication valve arranged to control a communication between the combustor and the exhaust guide, comprising determining the pressure in the combustor, whereby the control of the expander inlet valve comprises controlling the expander inlet valve at least partly based on the pressure in the combustor.

4. A method according to claim 3, wherein determining the pressure in the combustor comprises determining the pressure in the combustor at an opening event of the communication valve, whereby the control of the expander inlet valve comprises controlling the expander inlet valve at least partly based on the pressure in the combustor at an opening event of the communication valve.

5. A method according to claim 3, comprising determining a rotational speed of the engine system, whereby the pressure in the combustor is determined partly based on the determined rotational speed.

6. A method according to claim 1, where the engine system comprises a communication valve arranged to control a communication between the combustor and the exhaust guide, comprising determining whether there is a change in the exhaust guide pressure as a result of an opening event of the communication valve.

7. A method according to claim 1, wherein controlling the expander inlet valve comprises controlling the expander inlet valve so as for the pressure in the exhaust guide to be the same as the pressure in the combustor.

8. A method according to claim 1, wherein controlling the expander inlet valve comprises controlling the expander inlet valve so as for the pressure in the exhaust guide to be the same as the pressure in the combustor at an opening event of the communication valve.

9. A method according to claim 1, wherein controlling the expander inlet valve comprises controlling a timing of an opening event and/or a closing event of the expander inlet valve.

10. A method according to claim 1, where the expander comprises a cylinder and a piston arranged to reciprocate in the cylinder, the piston being connected to a crankshaft of the engine system, wherein controlling the expander inlet valve comprises controlling an opening event of the expander inlet valve so as to occur between 10 degrees before and 10 degrees after a top dead center position of the piston.

11. A method according to claim 1, where the expander comprises a cylinder and a piston arranged to reciprocate in the cylinder, the piston being connected to a crankshaft of the engine system, wherein controlling the expander inlet valve comprises controlling a closing event of the expander inlet valve so as to occur between 15 degrees after and 90 degrees after a top dead center position of the piston.

12. A method according to claim 1, wherein controlling the expander inlet valve comprises controlling a degree of opening of the expander inlet valve.

13. A method according to claim 1, wherein the compression of exhaust gases in the expander is such that the maximum pressure in the expander is 30%-100% of the pressure in the exhaust guide at the opening event of the expander inlet valve.

14. A computer comprising a computer program for performing the steps of claim 1 when the program is run on the computer.

15. A non-transitory computer readable medium carrying a computer program for performing the steps of claim 1 when the program product is run on a computer.

16. A control unit configured to perform the steps of the method according to claim 1.

17. An internal combustion engine system comprising the control unit according to claim 16.

18. An internal combustion engine system comprising a combustor arranged to receive air and fuel, and combust the received air and fuel, an expander arranged to expand exhaust gases from the combustion in the combustor and to extract energy from the expanded exhaust gases, an exhaust guide arranged to guide exhaust gases from the combustor to the expander, and an expander inlet valve arranged to control a communication between the exhaust guide and the expander, an air guide arranged to guide air to the combustor, wherein the engine system comprises pressure determining means arranged to determine the pressure in the exhaust guide, the expander inlet valve being arranged so as to present a variable and controllable opening sequence, and further determining the pressure in the combustor comprises determining a temperature, a pressure and/or an air mass flow in the air guide, and determining an amount of fuel provided to the combustor, and determining the pressure in the combustor at least partly based on the determined air guide temperature, pressure and/or air mass flow, and the determined fuel amount.

19. An engine system according to claim 18, wherein the variable and controllable opening sequence of the expander inlet valve is provided by a cam switching arrangement, a cam phasing arrangement, an arrangement with a coaxial two shaft combined cam lobe profile, or an arrangement with hydraulic and/or pneumatic valve actuation.

20. An engine system according to claim 18, wherein the expander inlet valve comprises a rotatable valve body presenting a valve body aperture located offset from a rotational axis of the valve body, the communication between the exhaust guide and the expander being controllable by changing the circumferential location of the valve body aperture.

21. An engine system according to claim 18, wherein the system is arranged to provide an injection of fuel into the exhaust guide and/or arranged to provide an injection of fuel into the combustor after a combustion in the combustor and before a reception of air and fuel in the combustor for a subsequent combustion.

22. A vehicle comprising the engine system according to claim 18.

* * * * *